US008363842B2

(12) United States Patent
Kenmochi et al.

(10) Patent No.: US 8,363,842 B2
(45) Date of Patent: Jan. 29, 2013

(54) PLAYBACK METHOD AND APPARATUS, PROGRAM, AND RECORDING MEDIUM

(75) Inventors: Chisato Kenmochi, Kanagawa (JP); Mitsuyuki Hatanaka, Kanagawa (JP)

(73) Assignee: Sony Corporation, Tokyo (JP)

( * ) Notice: Subject to any disclaimer, the term of this patent is extended or adjusted under 35 U.S.C. 154(b) by 1275 days.

(21) Appl. No.: 11/935,050

(22) Filed: Nov. 5, 2007

(65) Prior Publication Data

US 2008/0170704 A1 Jul. 17, 2008

(30) Foreign Application Priority Data

Nov. 30, 2006 (JP) ..... 2006-324775
Oct. 19, 2007 (JP) ..... 2007-272856

(51) Int. Cl.
*H04R 5/00* (2006.01)
*H04H 20/47* (2008.01)

(52) U.S. Cl. ..... 381/1; 381/2; 381/17; 381/22; 381/23

(58) Field of Classification Search ..... 381/2, 17, 381/19–23, 1; 700/94
See application file for complete search history.

(56) References Cited

U.S. PATENT DOCUMENTS 5,835,895 A 11/1998 Stokes, III
5,883,962 A * 3/1999 Hawks ..... 381/1
6,721,710 B1 4/2004 Lueck et al.
2009/0278995 A1* 11/2009 Oh ..... 348/731

FOREIGN PATENT DOCUMENTS

JP 2004-535145 11/2004
JP 2006-085183 3/2006
WO WO 03007656 1/2003

OTHER PUBLICATIONS

Author: Meltzer et al. Tittle: MPEG-4 HE-AAC v2—Audio coding for today's digital media world. Dated Jan. 2006. Publisher: EBU Technical Review.*
Author: Heiko Purnhagen, Tittle: Low Complexity Parametric Stereo Coding in MPEG-4, Date: Oct. 2004, Publisher: DAFx' 04: Pertinent pp. 163-168.*
Author: Meltzer et al, Tittle: MPEG-4 HE-AAC v2—audio coding for today's media world, date: Jan. 2006, Publisher: Coding Technologies.*

* cited by examiner

*Primary Examiner* — Xu Mei
*Assistant Examiner* — David Ton
(74) *Attorney, Agent, or Firm* — Finnegan, Henderson, Farabow, Garrett & Dunner LLP

(57) ABSTRACT

There is provided a playback method for decode-processing and playing back coded audio data which is transmitted with necessary stereo process information required for a stereo process intermittently multiplexed into coded information of a monaural audio signal. The playback method includes a first step of outputting stereo audio signals using the monaural audio signal if the necessary stereo process information is not supplied; a second step of starting updating stereo variables within filters, and outputting the stereo audio signals using the monaural audio signal until all the state variables are updated, if the necessary stereo process information is supplied; and a third step of performing the stereo process based on stereo process information acquired by the necessary stereo process information, on the monaural audio signal to generate and output stereo audio signals, if all the state variables within the filters are updated.

7 Claims, 10 Drawing Sheets

PLAYBACK METHOD AND APPARATUS, PROGRAM, AND RECORDING MEDIUM

BACKGROUND OF THE INVENTION

1. Field of the Invention

The present invention relates to a playback method and apparatus, a program, and a recording medium for decode-processing and playing back coded audio data which is transmitted with stereo process information intermittently multiplexed into coded information of a monaural audio signal.

2. Description of Related Art

Playback apparatuses are known which are supplied with a monaural audio signal and stereo process information, and which generate stereo audio signals by stereo processing the monaural audio signal on the basis of the stereo process information.

A typical stereo process such as above which is based on a monaural audio signal and stereo process information will now be described with reference to the drawings. FIG. 6 is a block diagram showing a configuration example of a typical stereo process apparatus, and FIG. 7 is a diagram showing an example of a signal to be supplied to the stereo process apparatus of FIG. 6. The stereo process information may be transmitted as multiplexed.

In FIG. 6, a monaural audio signal is supplied to an input terminal 41, and stereo process information is supplied to an input terminal 42. The monaural audio signal from the input terminal 41 is delivered to a band divider 44 via a selector switch 43 to be band-divided, and resultant band-divided monaural audio signals are delivered to a stereo processor 45. The stereo processor 45 is supplied with the stereo process information from the input terminal 42, and stereo-processes the band-divided monaural audio signals into left-channel (Lch) and right-channel (Rch) stereo signals. The Lch, Rch stereo signals are delivered to an Lch band synthesizer 51 and an Rch band synthesizer 52, respectively. An Lch audio signal from the band synthesizer 51 is delivered to a selector switch 53, where one of this Lch audio signal and a signal supplied from the selector switch 43 via a delay section 46 is selected, and the selected signal is delivered to a selector switch 54 and an output terminal 55. An Rch audio signal from the band synthesizer 52 is delivered to the selector switch 54, where one of this Rch audio signal and the signal from the selector switch 53 is selected, and the selected signal is delivered to an output terminal 56.

FIG. 7 shows an example of a signal to be supplied to the stereo process apparatus of FIG. 6. The signal is numbered #0, #1, #2, in transmission units of coded audio data, such as in units of frames or blocks. In the figure, M denotes a monaural audio signal, and S denotes stereo process information. In the example of FIG. 7, the monaural audio signal M is always transmitted, whereas the stereo process information S is transmitted as multiplexed and at a rate of one every five times. In this case, stereo process information S delivered as contained in a transmission unit #0 is used for a stereo process during a period corresponding to transmission units #0 to #4, and then switched to next stereo process information S at a timing corresponding to a transmission unit #5. This stereo process information S delivered at the timing corresponding to the transmission unit #5 is used during a period corresponding to transmission units #5 to #9. Thereafter, previously delivered stereo process information S is similarly used until next stereo process information S is delivered.

In the configuration of FIG. 6, when stereo process information is supplied, the selector switches 43, 53, 54 are switched to selectable terminals B. Namely, the monaural audio signal supplied from the input terminal 41 is band-divided by the band divider 44, and the stereo signals are generated by the stereo processor 45 on the basis of the stereo process information. The generated stereo signals are band-synthesized by the band synthesizers 51, 52 of the respective channels, and then outputted as the Lch, Rch stereo audio signals from the output terminals 55, 56, respectively.

Meanwhile, in a discontinuous frame playback, such as a fast-forwarding playback based on a playback by decimating frames (transmission units), or in a playback from an arbitrary frame, multiplexed coded information may drop out in some cases. When coded audio data is supplied from an arbitrary frame (transmission unit) due to such a discontinuous frame playback or the like, the absence of usable stereo process information may occur. For example, when the input starts at a position corresponding to the transmission unit #2 of FIG. 7, the stereo process information S contained in the transmission unit #0 is absent due to frame decimation or the like, so that there is no usable stereo process information during a period corresponding to the transmission units #2 to #4.

In the apparatus of FIG. 6, in order to prevent the number of channels of its output audio signals from being changed due to the stereo process information being present or absent, it is arranged to output the monaural audio signal to both the stereo left and right channels, even in the absence of usable stereo process information (e.g., during the period corresponding to the transmission units #2 to #4 of FIG. 7). Specifically, by switching the selector switches 43, 53, 54 to selectable terminals A, the apparatus outputs identical monaural audio signals from the output terminals 55, 56, respectively. Here, when the selector switch 43 is switched to its selectable terminal A, the monaural audio signal from the input terminal 41 is delivered to the delay section 46. This is to give the supplied monaural audio signal a delay that occurs at the band divider 44, in view of a fact that the band divider 44 holds a state variable as in, e.g., a FIR filtering process, and updates the state variable and causes a delay every time it performs the process. Since the band synthesizers and the like perform their band synthesis in a manner causing no delay, the delay section 46 takes care of only the delays at the band divider 44. The monaural audio signal from the delay section 46 is outputted from the Lch output terminal 55 via the selector switch 53, and also outputted from the Rch output terminal 56 via the selector switch 54. It is noted that internal state variables of the band divider 44 and the like are initialized when there is no usable stereo process information such as in the period corresponding to the transmission units #2 to #4 of FIG. 7.

Accordingly, if the data is supplied at the position corresponding to the transmission unit #2 of FIG. 7, in the stereo process apparatus of FIG. 6, the internal state variables are initialized, and also the selector switches 43, 53, 54 are switched to their selectable terminals A during the period corresponding to the above-mentioned transmission units #2 to #4. Then, upon input of the data at the position corresponding to the transmission unit #5, the selector switches 43, 53, 54 are switched to selectable terminals B, and also the internal state variables are updated. It is noted that switching operations of the selector switches 43, 53, 54, and processing operations of the relevant sections are controlled by a control section, not shown, in accordance with the content of input data, internal states, or the like.

Here, a specific example of a coding system will be described below, by which part of coding information for the stereo process and the like is multiplexed into a monaural audio signal to be transmitted.

Audio data coded by, e.g., an HE AAC (High Efficiency Advanced Audio Coding, International Standard ISO/IEC 14496-3) coding system, particularly, an HE AAC v2 (version 2) coding system, is transmitted with part of coded information required for decoding, multiplexed thereinto. This HE AAC v2 coding system is configured by combining three technologies, i.e., an advanced audio coding (AAC) process, a spectral band replication (SBR) process, and a parametric stereo (PS) process. Coded information for the SBR process and the PS process is transmitted as partially multiplexed.

The AAC process is a coding process in an audio compression algorithm standardized by MPEG (Moving Picture Experts Group) audio. The SBR process is a coding process for band extension by dividing an input signal into a plurality of subbands, and replicating high sound frequency bands from lower frequency bands thereof. The PS process is a coding process for spatial coding using spatial information and the like required for generating stereo signals from a monaural signal.

Coded audio data which is coded by the above-mentioned HE AAC v2 system includes AAC core coded information equivalent to a monaural audio data coded by the above-mentioned AAC coding system, the coded information for the above-mentioned SBR process, and the coded information for the above-mentioned PS process. The coded information for the SBR process includes coded information (sbr header) which is multiplexed and intermittently transmitted, and coded information (sbr data) which is always transmitted. For decoding the sbr data (SBR data), the sbr header (SBR header) is required. As to the sbr header (SBR header), its content can be changed under a specific rule, and also its transmission timing is subject to an operational practice. The coded information (ps data) for the PS process is transmitted as contained in an extended area of the sbr data (SBR data). Thus, for decoding the ps data (PS data), the sbr header (SBR header) information is likewise required. Namely, the sbr header (SBR header) is necessary stereo process information required for acquiring the ps data (PS data) for the stereo process. FIG. 8 shows an example of audio data which is coded by the HE AAC v2 coding system. In FIG. 8, AC denotes the AAC core coded information, SH denotes the above-mentioned sbr header (SBR header), and SD denotes the above-mentioned sbr data (SBR data).

As shown in FIG. 8, for decoding SBR data SD and PS data contained in its extended area, an SBR header SH which is intermittently transmitted is required. However, in a playback from an arbitrary frame such as mentioned above, the SBR header SH which is multiplexed may drop out in some cases. Here, unless multiplexed frames are particularly monitored constantly by a higher-level system or the like, a decoding process using the AAC core coded information AC is performed to generate output audio signals until a frame from which the multiplexed SBR header SH can be acquired arrives. The decoding process in this case includes the above-mentioned AAC decoding process, and an up-sampling process based on the above-mentioned SBR process for band division and band synthesis.

Upon arrival of a frame containing multiplexed SBR header SH, the above-mentioned SBR data SD and the PS data contained in its extended area are decoded using this SBR header SH. Then, a "complete" decoding process (including the stereo process) using these SBR data and PS data is performed to generate output stereo audio signals. In the decoding process for the above-mentioned HE AAC v2 coded audio data, the above-mentioned AAC decoding process is performed, and then in the above-mentioned SBR process, band division and generation of high frequency (HF) components are performed, after which stereo signals are generated from the band-divided monaural signals on the basis of spatial information coded in the above-mentioned PS process, and finally output stereo audio signals are generated by a band synthesis process in the SBR process.

FIG. 9 is a block diagram showing a configuration example of a playback apparatus for coded audio data which is coded by the above-mentioned HE AAC v2 system. A coded audio stream is supplied, by transmission, to an input terminal 11 of FIG. 9. The coded audio stream contains the AAC core coded information, the HF generation coded information (SBR data), and the PS coded information (PS data). Part of the coded information is transmitted as multiplexed. For decoding the HF generation coded information (SBR data) and the PS coded information (PS data), an SBR header SH which is transmitted as multiplexed is required, as mentioned above.

In the HE AAC v2 coding system, when part of the SBR header SH differs from that contained in a previous frame, an initialization for the SBR process needs to be performed. By the initialization for the SBR process, state variables (delay signals) in QMF analyzers/synthesizers, a hybrid analyzer, and the like, later-described, are initialized. A state variable (delay signal) herein used is intended to mean data (signal) held at a delay element within a filter. In a filtering process, a delay occurs within a period from the input to the output of a signal in accordance with a filtering length, and the state variable means this delay signal.

By the way, monaural audio data acquired by decoding the AAC coded information which is coded by the HE AAC v2 coding system is up-sampled by carrying out QMF analysis and QMF synthesis in the SBR process. For example, the apparatus SBR-processes the monaural audio data after the AAC decoding, at a sampling rate of 24 kHz, whereby the apparatus outputs audio data whose sampling rate is 48 kHz.

In FIG. 9, the coded audio data from the input terminal 11 is delivered to a payload deformatter 12 to be separated into AAC core coded information to an AAC core decoder 13, and into HF generation coded information (SBR data)/PS coded information (PS data). The AAC core decoder 13 decodes the supplied AAC core coded information, generates an AAC core monaural signal, and delivers the generated signal to an SBR processor 20. A parser 14 of the SBR processor 20 acquires multiplexed information such as the HF generation coded information and the like from the payload deformatter 12, checks their content, judges whether or not an initialization for the SBR process is needed. If the initialization is needed, the parser 14 outputs an initialization control signal from a terminal 14*t*, so that an initialization for the SBR process will be performed on relevant sections, as described later. The monaural audio signal delivered to the SBR processor 20 from the AAC core decoder 13 is band-divided by a QMF analyzer 21, and resultant band-divided signals are delivered to a selector switch 22. If the HF generation coded information (SBR data) is supplied, the selector switch 22 is switched for connection to a selectable terminal B, C, so that the signals from the QMF analyzer 21 are delivered to an HF generator 23. The HF generator 23 generates HF signals. An envelope adjuster 24 makes an envelope adjustment. Resultant signals are delivered to a selector switch 25.

If stereo process information is acquired from the above-mentioned PS coded information (PS data), the selector switches 22, 25 are switched for connection to selectable terminals C. Signals from the selectable terminal C of the selector switch 25 are delivered to a hybrid analyzer 27. The hybrid analyzer 27 further band-divides low frequency (LF) signals of the supplied band-divided signals, and supplies resultant signals to a signal de-correlator 29 and a stereo processor 30. The signal de-correlator 29 de-correlates the supplied signals, makes an acoustic adjustment thereon, and supplies resultant signals to the stereo processor 30. The stereo processor 30 generates Lch, Rch stereo signals from the supplied band-divided signals and stereo process information. For the generated Lch, Rch stereo signals, hybrid synthesizers 31, 32 of the respective channels band-synthesize the band-divided signals obtained by the above-mentioned hybrid analyzer 27, and further, QMF synthesizers 33, 34 band-synthesize the band-divided signals obtained by the above-mentioned QMF analyzer 21, to generate Lch, Rch stereo output audio signals. The Lch audio signal from the QMF synthesizer 33 is delivered to a selector switch 36 and an output terminal 37. The Rch audio signal from the QMF synthesizer 34 is delivered to the selector switch 36, where one of this Rch audio signal and the signal from the QMF synthesizer 33 is selected, and the selected signal is delivered to an output terminal 38.

If multiplexed information such as the above-mentioned stereo process information is not transmitted, the selector switches 22, 25, 35, 36 of FIG. 9 are switched for connection to either the selectable terminals A or B. In order to keep a fixed sampling frequency for the output audio signals, only up-sampling is performed using the QMF analyzer 21 and the QMF synthesizer 33. Additionally, in order to keep a fixed number of output channels, the Lch audio signal is copied for the Rch audio signal to generate the output signals.

FIG. 10 is a flowchart for illustrating a decoding operation such as mentioned above, e.g., in the configuration of the above-mentioned FIG. 9.

In FIG. 10, on coded information such as the coded audio stream to be supplied to the above-mentioned input terminal 11, a decoding (deformatting) process for data coded by the above-mentioned HE AAC v2 system is performed in step S101 to extract HF generation coded information and spatial coded information such as mentioned above, as multiplexed coded information. Further, on the above-mentioned AAC core information, an AAC signal process is performed in step S102. In the following step S103, it is judged whether or not the above-mentioned SBR process is to be performed, and if YES, the process proceeds to step S104, whereas if NO, the process proceeds to step S114. These processes correspond to, e.g., the processing performed by the payload deformatter 12 and the AAC core decoder 13 of FIG. 9.

In step S104, a QMF band division process is performed by, e.g., the above-mentioned QMF analyzer 21. In the following step S105, it is judged whether or not the multiplexed coded information is already decoded, and if YES, the process proceeds to step S106, whereas if NO, the process proceeds to step S113. In step S106, an HF signal generation process is performed using the multiplexed HF generation coded information (already decoded information) by, e.g., the above-mentioned HF generator 23, and then, in the following step S107, it is judged whether or not the PS process is to be performed.

If it is judged YES (the PS process is to be performed) in step S107, control proceeds to step S108, where a hybrid analysis process is performed. Then, in step S109, a stereo signal generation process based on the spatial information is performed, and further in step S110, a hybrid synthesis process is performed. Thereafter, control proceeds to step S111. These processes correspond to, e.g., processing extending from the processing performed by the hybrid analyzer 27 to the processing performed by the hybrid synthesizers 31, 32 of FIG. 9. If it is judged NO (the PS process is not to be performed) in step S107, control proceeds to step S111.

In step S111, an Lch QMF band synthesis process is performed, and in step S112, an Rch QMF band synthesis process is performed, and resultant audio signals are outputted. Furthermore, in the above-mentioned step S113, the Lch QMF band synthesis process is performed, and in step S114, the monaural signal is replicated, as necessary, to generate stereo signals, and resultant audio signals are outputted. These processes correspond to, e.g., the processing performed by the QMF synthesizers 33, 34 via the selector switches 22, 35, 36 of the above-mentioned FIG. 9.

As related-art technologies, Published translation of International Patent Application (KOHYO) No. 2004-535145 (Patent Reference 1) and Japanese Patent Application Publication (KOKAI) No. JP 2006-085183 (Patent Reference 2) disclose a technology for generating stereo audio signals by stereo-processing a monaural audio signal on the basis of stereo process information, and ISO/IEC 14496-3: 2005, Information technology—Coding of audio-visual objects, —Part 3: Audio (Non-patent Reference 1) discloses a standard of the above-mentioned HE AAC (High Efficiency Advanced Audio Coding) coding system.

SUMMARY OF THE INVENTION

By the way, in a playback from an arbitrary frame by, e.g., playing back discontinuous frames such as playing back of the above-mentioned frame decimation, the internal state variables are initialized, and thereafter, when partially multiplexed coded information such as the stereo process information is supplied, the updating of these state variables is started. Consequently, abnormal sounds occur due to the influence of the filtering delays and the like.

For example, in the configuration of the above-mentioned FIG. 6, if the input starts at the position corresponding to the transmission unit #2 of the above-mentioned FIG. 7, and when stereo process information is supplied as contained in the transmission unit #5 from the state in which there is no usable stereo process information during the period corresponding to the transmission units #2 to #4, the selector switches 43, 53, 56 are switched to their selectable terminals B. The band divider 44 generates band-division signals for the first time after these switches are switched to the selectable terminals B. Since the state variable of the band divider 44 at this point of time is in an initialized state, the influence of this state is exerted on an output corresponding to the transmission unit #5. For example, the influence may include the damping of the output signals, which may cause abnormal sounds.

Furthermore, in the case of the configuration of the above-mentioned FIG. 9, when frames are played back discontinuously, such as in a fast-forwarding playback by frame-decimating audio data coded by the HE AAC v2 system, there may be cases where the multiplexed sbr header (SBR header) drops out. For example, in a case of the example of FIG. 8, when the playback starts at a frame (transmission unit) #1, an SBR header SH is transmitted at a timing corresponding to a frame #5 for the first time. In this case, until a frame from which an SBR header SH can be acquired arrives, the SBR coded information and the PS coded information in the SBR data SD cannot be decoded, so that the selector switch 22 is connected to its selectable terminal A, the selector switch 35 is connected to its selectable terminal A, and the selector switch 36 is connected to its selectable terminal B. Accordingly, the AAC core monaural audio signal is up-sampled using the QMF analyzer 21 and the Lch QMF synthesizer 33 in the SBR process, and the identical output audio signals are generated for the stereo left and right channels.

In the case where frames are played back discontinuously in this way, the state variables (delay signals) of the filters within the playback apparatus and the input audio data coded by the HE AAC v2 coding system result in discontinuity. Thus, the playback apparatus needs to be initialized (including SBR process initialization) to initialize its internal state variables. These state variables (delay signals) within the playback apparatus include state variables of the QMF analyzer 21, QMF synthesizers 33, 34, and hybrid analyzer 27, and these state variables are set to 0 when initialized. Since the SBR coded information/PS coded information cannot be decoded until an SBR header SH is transmitted, the playback apparatus switches the selector switches 22, 35, 36 to their selectable terminals A to allow the monaural audio signal from the AAC core decoder 13 to be up-sampled through processing by the QMF analyzer 21 and the Lch QMF synthesizer 33, to output resultant output audio signals to the stereo left and right channels. When an SBR header SH is transmitted, the SBR coded information and the PS coded information are decoded for the first time after the initialization of the playback apparatus, and the SBR process and the PS process are executed. Since the QMF analyzer 21 and the Lch QMF synthesizer 33 perform their processing for up-sampling even before the SBR header SH is transmitted, their state variables are kept updated. Meanwhile, the state variable of each of the hybrid analyzer 27 and the Rch QMF synthesizer 34 is in an initialized state. This state exerts influence on the downstream processing, thereby causing abnormal sounds in the output audio signals. FIGS. 11A, 11B show examples of the Lch, Rch stereo output audio signals at this point of the processing.

FIGS. 11A, 11B show states from a state in which usable multiplexed coded information (stereo information and the like) is absent, e.g., from a state in which only an AAC-LC (Low Complexity) coded information signal is supplied, and only up-sampling is performed in the SBR process, to a state in which multiplexed coded information containing stereo process information becomes effective (usable) at a time t1 whereby the AAC process, the SBR process, and the PS process are started. FIG. 11A shows the Lch output audio signal, whereas FIG. 11B shows the Rch output audio signal.

In FIGS. 11A, 11B, at the time t1, the playback apparatus recognizes multiplexed coded information for the first time after initializing the above-mentioned internal state variables. However, since the state variables change from their initialized states, the influence of the state variable of a band synthesizer (the Rch QMF synthesizer 34) for the above-mentioned SBR process is exerted on the Rch output audio signal between the times t1 and t2, whereas the influence of the state variable of a hybrid filter (the hybrid analyzer 27) for the above-mentioned PS process is exerted on both the Lch, Rch output audio signals between the times t2 and t3. As a result, abnormal sounds occur in the output audio signals.

For avoiding the disadvantage, it is conceivable to constantly monitor multiplexed coded information. In this case, the multiplexed information is transmitted simultaneously with normal coded information. Thus, all the coded information needs to be decoded, and this prevents reduction of the processing volume.

In view of the above circumstances, it is desirable to provide a playback apparatus and method, a program, and a recording medium, all being capable of effectively preventing negative influence (occurrence of abnormal sounds and the like) from being exerted on output audio signals, the negative influence being caused by filtering delays and the like that occur when required coded information is supplied from a state in which internal state variables are as initialized, in a case where a playback is performed from an arbitrary position because multiplexed coded information and information (SBR header and the like) required for decoding are transmitted intermittently.

In one embodiment of the present invention, in decode-processing and playing back coded audio data which is transmitted with necessary stereo process information required for a stereo process intermittently multiplexed into coded information of a monaural audio signal, it is arranged to output stereo audio signals using the monaural audio signal if the necessary stereo process information is not supplied, to start updating stereo variables within filters, and to output the stereo audio signals using the monaural audio signal until all the state variables are updated if the necessary stereo process information is supplied, and to perform the stereo process based on stereo process information acquired by the necessary stereo process information, on the monaural audio signal to generate and output stereo audio signals if all the state variables within the filters are updated.

Here, it is preferable to perform the above-mentioned stereo process on band-extended monaural audio signals.

Furthermore, it is preferable to divide the above-mentioned monaural audio signal into at least two subbands by a band division filtering process, up-sample resultant band-divided monaural audio signal by a band synthesis filtering process, and output the stereo audio signals using the monaural audio signal, if the above-mentioned necessary stereo process information is not supplied. If the above-mentioned necessary stereo process information is supplied, it is preferable to process a state variable within a filter for the monaural audio signal as filtering state variables for the stereo audio signals.

Furthermore, the above-mentioned coded audio data has AAC core coded information equivalent to the monaural audio data based on an HE AAC (High Efficiency Advanced Audio Coding) coding system, coded information for an SBR (Spectral Band Replication) process, and coded information for a PS (Parametric Stereo) process. The coded information for the above-mentioned SBR process includes SBR data (sbr data) being coded information which is always transmitted, and an SBR header (sbr header) being coded information which is intermittently transmitted as multiplexed. PS data (ps data) being the coded information for the above-mentioned PS process is transmitted as contained in an extended area of the above-mentioned SBR data. The SBR header is the above-mentioned necessary stereo process information required for decoding the above-mentioned SBR data.

These and other features and aspects of the invention are set forth in detail below with reference to the accompanying drawings in the following detailed description of the embodiments.

DETAILED DESCRIPTION OF THE EMBODIMENT

A specific embodiment of the present invention will be described below in detail with reference to the accompanying drawings.

Figure 1:
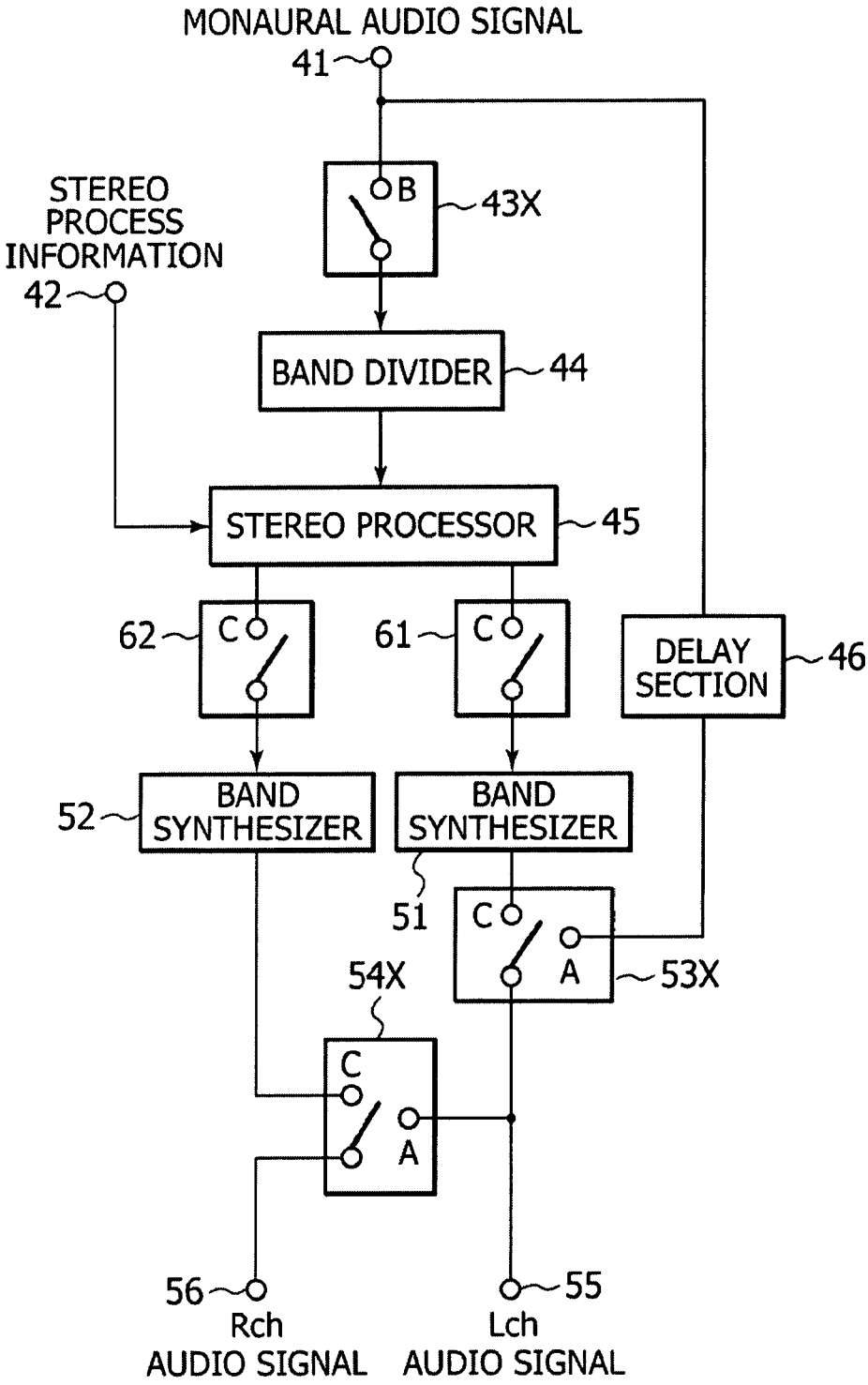
FIG. 1 is a block diagram showing a schematic configuration of a playback apparatus according to an embodiment of the present invention.
Figure 6:
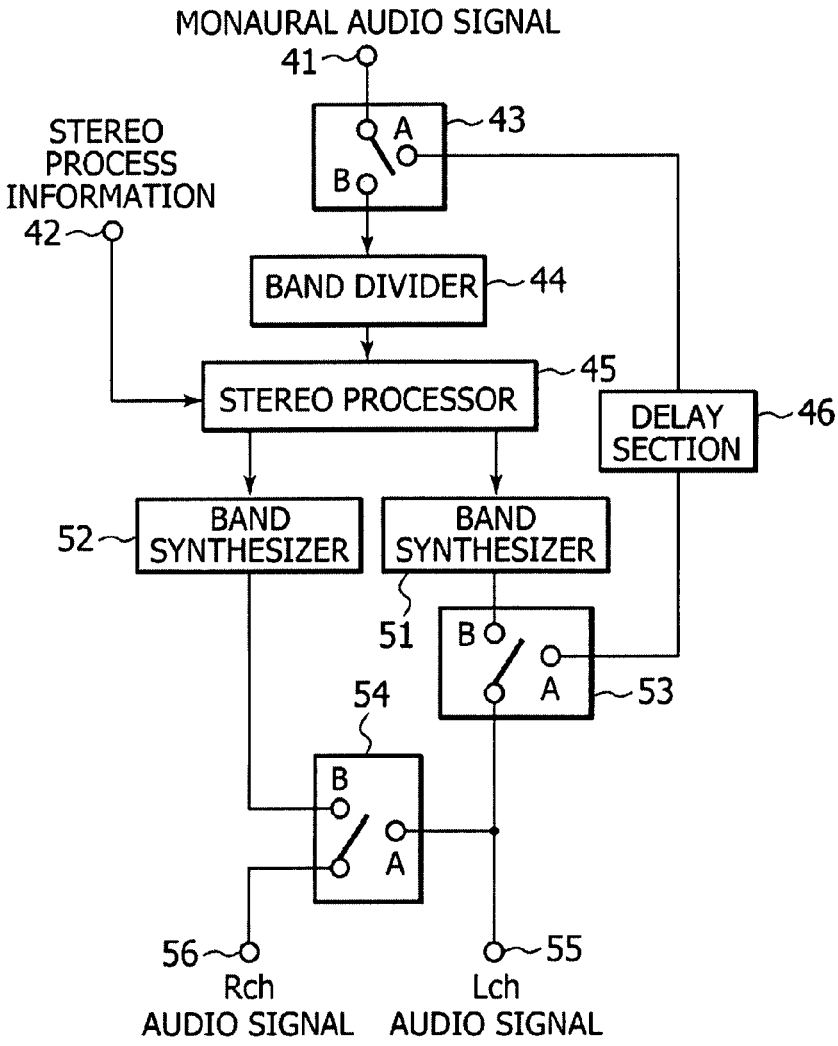
FIG. 6 is a block diagram showing a configuration example of a related-art stereo process apparatus.

FIG. 1 is a block diagram showing an example schematic configuration of a stereo process apparatus used for a playback apparatus or playback method according to an embodiment of the present invention. In FIG. 1, components corresponding to those of FIG. 6 are given the same reference numerals.

A monaural audio signal is supplied to an input terminal 41 and stereo process information is supplied to an input terminal 42, of FIG. 1. The monaural audio signal from the input terminal 41 is delivered to a switch 43X and a delay section 46. The monaural audio signal from the switch 43X is delivered to a band divider 44 to be band-divided, and resultant band-divided monaural audio signals are delivered to a stereo processor 45. The stereo processor 45 is supplied with the stereo process information from the input terminal 42, and stereo-processes the band-divided monaural audio signals into left-channel (Lch) and right-channel (Rch) stereo signals. Then, of the resultant Lch and Rch stereo signals, the Lch signals are delivered to a band synthesizer 51 via a switch 61, and the Rch signals are delivered to a band synthesizer 52 via a switch 62. An Lch audio signal from the band synthesizer 51 is delivered to a selector switch 53X, where one of this Lch audio signal and the signal supplied thereto via the delay section 46 is selected, and the selected signal is delivered to a selector switch 54X and an output terminal 55. An Rch audio signal from the band synthesizer 52 is delivered to the selector switch 54X, where one of this Rch audio signal and a signal from the selector switch 53X is selected, and the selected signal is delivered to an output terminal 56. It is noted that switching operations of the selector switches 43X, 53X, 54X, on/off operations of the switches 61, 62, and processing operations of the relevant sections are controlled by a control section, not shown, in accordance with the content of input data, internal states, or the like.

Figure 7:
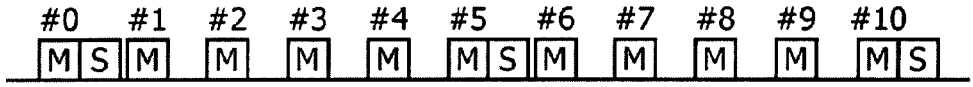
FIG. 7 is a diagram showing an example of a signal to be supplied to the stereo process apparatus of FIG. 6.

In a case where an input signal (a monaural audio signal M and intermittent stereo process information S) such as shown in the above-mentioned FIG. 7 is supplied to a stereo process apparatus such as shown in FIG. 1, the stereo process information S delivered as contained in the transmission unit #0 is used for a stereo process during the period corresponding to the transmission units #0 to #4, and then switched to the next stereo process information S at the timing corresponding to the transmission unit #5. This stereo process information S delivered at the timing corresponding to the transmission unit #5 is used during the period corresponding to the transmission units #5 to #9, as mentioned earlier.

If the usable stereo process information is available in this way, the switch 43X is connected to a selectable terminal B, the switches 61, 62 are connected to selectable terminals C, and the selector switches 53X, 54X are switched for connection to selectable terminals C. Under this condition, the monaural audio signal supplied from the input terminal 41 is band-divided by the band divider 44, and stereo signals are generated by the stereo processor 45 on the basis of the stereo process information. Then, the generated stereo signals are band-synthesized by the band synthesizers 51, 52 of the respective channels, and resultant Lch, Rch stereo audio signals are outputted from the output terminals 55, 56, respectively.

Meanwhile, when coded audio data is supplied from an arbitrary frame (transmission unit) due to a discontinuous frame playback such as a fast-forwarding playback, or the like, the absence of usable stereo process information may occur. For example, when the input starts at the position corresponding to the transmission unit #2 of FIG. 7, the stereo process information S contained in the transmission unit #0 is not supplied due to frame decimation or the like, resulting in the absence of usable stereo process information during the period corresponding to the transmission units #2 to #4. During the period corresponding to the transmission units #2 to #4 in which usable stereo process information is thus absent, in the stereo process apparatus of FIG. 1, internal state variables of, e.g., the band divider 44 and the like are initialized, and also the selector switches 53X, 54X are connected to the selectable terminals A. Thus, the monaural audio signal supplied from the input terminal 41 via the delay section 46 is outputted from the Lch output terminal 55 via the selector switch 53X, and also from the Rch output terminal 56 via the selector switch 54X. This arrangement prevents the number of channels of the output audio signals from being changed due to the presence/absence of the stereo process information. It is noted that the delay section 46 is provided in consideration of a delay caused by, e.g., a FIR filtering process or the like performed by the band divider 44.

Then, when the data at the position corresponding to the transmission unit #5 of the above-mentioned FIG. 7 is supplied and the usable stereo process information S is thus also supplied, first, the switch 43X is connected to the selectable terminal B, so that the monaural audio signal is supplied to the band divider 44. However, until the state variable of this band divider 44 is fully updated, the switches 61, 62, the selector switches 53X, 54X are not connected to their selectable terminals C. For this reason, when the stereo process information is supplied for the first time from a state in which there is no usable stereo process information and in which the internal state variables are initialized, the switch 43X is connected to the selectable terminal B, so that the monaural audio signal supplied via the delay section 46 is outputted from the output terminals 55, 56 via the selectable terminals A of the selector switches 53X, 54X, respectively while updating the state variable of the band divider 44. Thereafter, when the state variable of the band divider 44 is fully updated, the switches 61, 62 are connected to the terminals C, and also the selector switches 53X, 54X are switched for connection to the selectable terminals C, so that stereo processed signals such as mentioned above are outputted from the output terminals 55, 56 as output audio signals, respectively. Accordingly, the output audio signals are free from the influence of the state in which the state variable of the band divider 44 is initialized, and thus the audio signals for which occurrence of abnormal sounds is prevented can be obtained.

Namely, in the embodiment of the present invention, when coded audio data, which is transmitted with stereo process information intermittently multiplexed into coded information of a monaural audio signal, is to be decode-processed and played back, if the stereo process information is not supplied, it is arranged to output stereo signals using the monaural audio signal, whereas if the stereo process information is supplied, it is arranged to start updating state variables within filters, and to output the stereo audio signals using the monaural audio signal until all the state variables are updated. Then, if all the state variables within the filters are updated, it is arranged to perform a stereo process based on the stereo process information, on the monaural audio signal to generate and output stereo audio signals.

Figure 2:
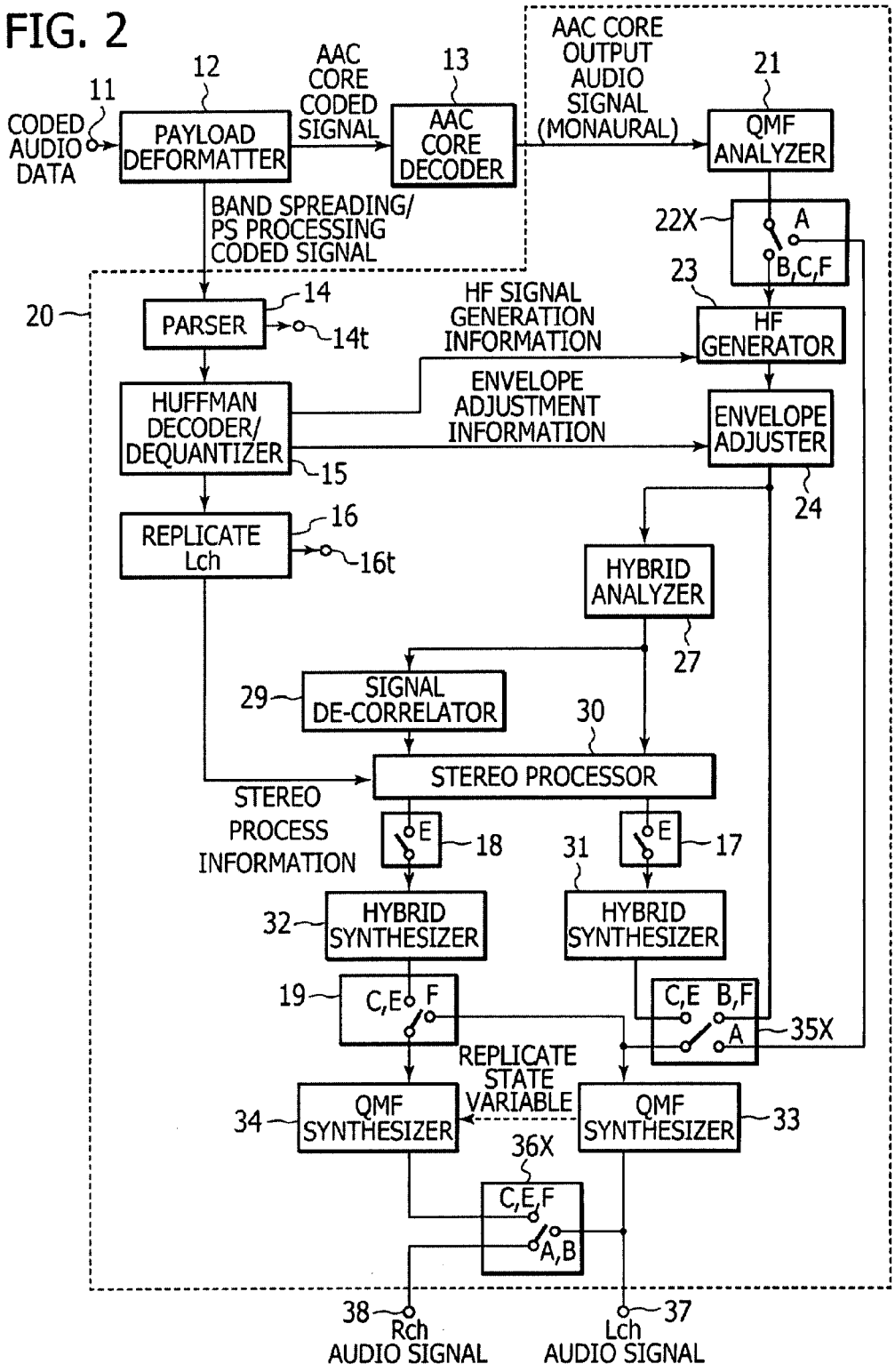
FIG. 2 is a block diagram showing a configuration example in which the embodiment of the present invention is applied to a playback apparatus for playing back coded audio data which is coded by an HE AAC v2 system.
Figure 9:
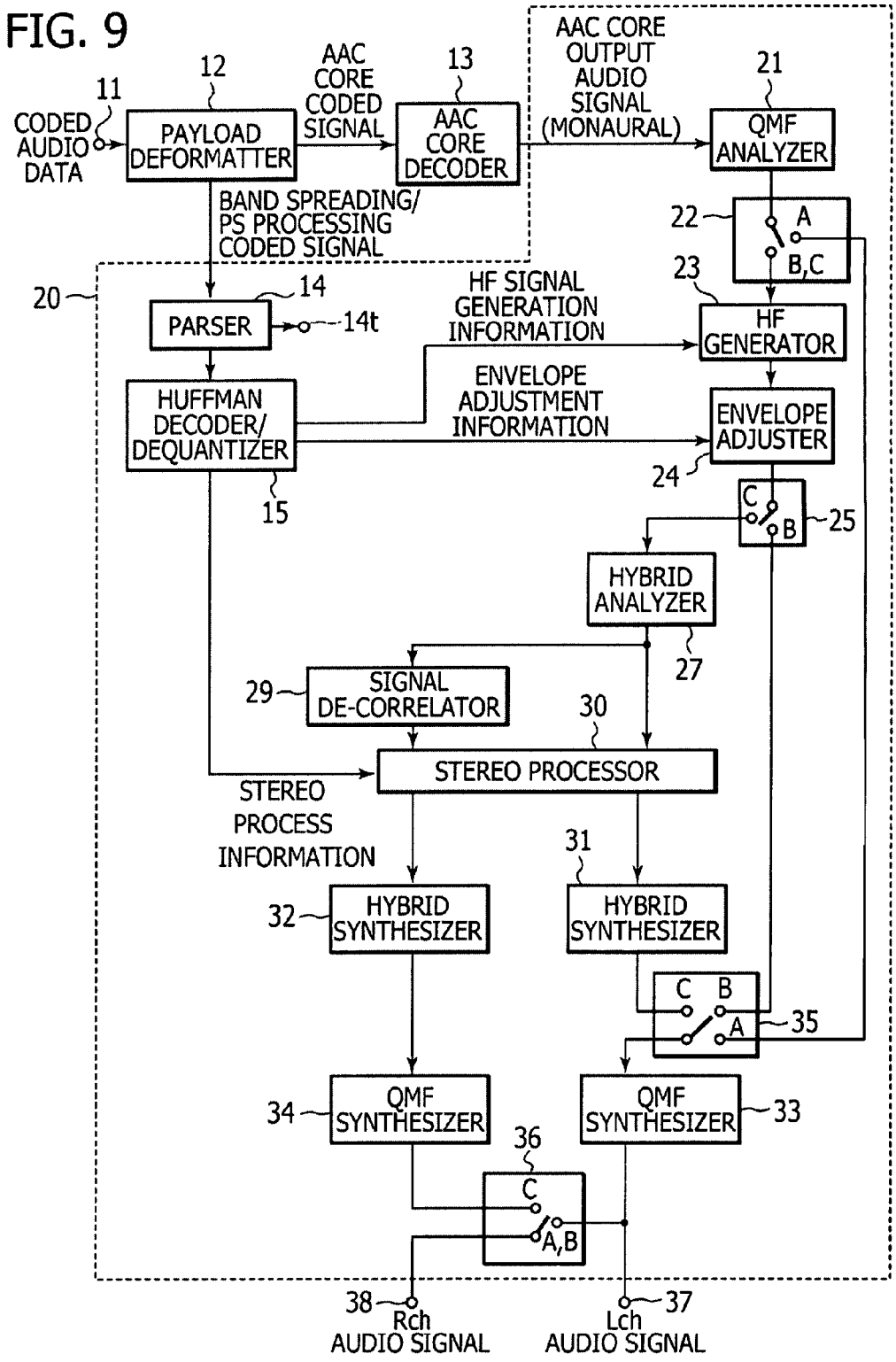
FIG. 9 is a block diagram showing a configuration example of a playback apparatus for playing back coded audio data which is coded by the HE AAC v2 system.

Next, a configuration example of a playback apparatus will be described with reference to FIG. 2, to which the embodiment of the present invention is applied for playback of coded audio data which is coded by the above-mentioned HE AAC (High Efficiency Advanced Audio Coding, International Standard ISO/IEC 14496-3) coding system, particularly, the HE AAC v2 (version 2) coding system. In FIG. 2, components corresponding to those of the above-mentioned FIG. 9 are given the same reference numerals.

A coded audio stream is supplied, by transmission, to an input terminal 11 of FIG. 2. The coded audio stream contains AAC core coded information, HF generation coded information (band extension coded information for the SBR process), and PS coded information (spatial information for the stereo process). Part of the coded information is transmitted as multiplexed. Namely, as described along with the above-mentioned FIG. 8, the coded information SD (SBR data) for the above-mentioned SBR process is always multiplexed into the AAC core coded information AC, whereas the SBR header SH required for decoding this SBR data SD is intermittently multiplexed into the coded information AC. The PS data for the above-mentioned PS process is transmitted as contained in an extended area of the SBR data SD. Since the SBR header SH is also required to acquire the PS data, this SBR header SH is the necessary stereo process information.

Furthermore, if the HF generation coded information (SBR data) and the PS coded information (PS data) are contained, an audio signal to be decoded by an AAC core decoder 13 is outputted at a half sampling rate of the final output audio signals. Thus, by combining a QMF analyzer 21 with QMF synthesizers 33, 34, the audio signal is up-sampled. For example, if an output signal from the AAC core decoder 13 is a signal whose sampling frequency is 24 kHz, the output audio signals from the QMF synthesizers 33, 34 are signals whose sampling frequency is 48 kHz.

The coded audio data from the input terminal 11 is delivered to a bitstream payload deformatter, that is, a payload deformatter 12 to be separated into the AAC core coded information to the AAC core decoder 13, and into the HF generation coded information/PS coded information.

The HF generation coded information/PS coded information is delivered to an SBR processor 20, and then delivered to a Huffman decoder/dequantizer 15 via a bit stream parser, that is, a parser 14 of the SBR processor 20. At the Huffman decoder/dequantizer 15, HF signal generation information, envelope adjustment information, and stereo process information are extracted. The former two items of the extracted information are delivered to an HF generator 23 and an envelope adjuster 24, respectively, whereas the latter one item is delivered to a stereo processor 30 via an Lch replication process judgment section 16. The parser 14 of the SBR processor 20 acquires multiplexed information such as the HF generation coded information and the like from the payload deformatter 12, checks their content, judges whether or not an SBR process initialization is needed, and if so, outputs an initialization control signal from a terminal 14*t*, so that an SBR process initialization is performed on the relevant sections as later described. Furthermore, the Lch replication process judgment section 16 judges that multiplexed coded information is acquired for the first time after the SBR process initialization, and outputs a judgment output from a terminal 16*t*, so that the Rch QMF synthesizer 34 performs a later-described process of replicating a state variable (delay signal) of the Lch QMF synthesizer 33.

The AAC core decoder 13 decodes the supplied AAC core coded information, and generates an AAC core monaural audio signal. The decoder 13 delivers the generated monaural audio signal to the QMF analyzer 21 of the SBR processor 20. The QMF analyzer 21 band-divides the monaural audio signal into sixty-four bands, and delivers resultant band-divided signals to a selector switch 22X. If the HF generation coded information (SBR data) is supplied, the selector switch 22X is switched for connection to a selectable terminal B, C, so that the signals from the QMF analyzer 21 are delivered to the HF generator 23. The HF generator 23 generates HF signals, and the envelope adjuster 24 makes an envelope adjustment. The envelope adjuster 24 delivers resultant signals to a hybrid analyzer 27 and a selector switch 35X.

If stereo process information is acquired from the above-mentioned PS coded information (PS data), the selector switch 22X is switched for connection to the selectable terminal C. The hybrid analyzer 27 further band-divides LF signals of the supplied band-divided signals, and supplies resultant further band-divided signals to a signal de-correlator 29 and the stereo processor 30, together with HF ones of the previously band-divided signals. The signal de-correlator 29 de-correlates the supplied signals, makes an acoustic adjustment thereon, and supplies resultant signals to the stereo processor 30. The stereo processor 30 generates Lch, Rch stereo signals from the supplied band-divided signals and the stereo process information. The generated stereo signals of the respective channels are delivered to hybrid synthesizers 31, 32 of the respective channels via switches 17, 18, respectively. The hybrid synthesizers 31, 32 band-synthesize the divided bands obtained by the above-mentioned hybrid analyzer 27. Resultant signals from the hybrid synthesizer 31 are delivered to the QMF synthesizer 33 and a selector switch 19 via the selector switch 35X, whereas resultant signals from the hybrid synthesizer 32 are delivered to the QMF synthesizer 34 via the selector switch 19. The QMF synthesizers 33, 34 of the respective channels band-synthesize the divided bands obtained by the above-mentioned QMF analyzer 21, to generate Lch, Rch stereo output audio signals, respectively. The Lch audio signal from the QMF synthesizer 33 is delivered to a selector switch 36X and an output terminal 37. The Rch audio signal from the QMF synthesizer 34 is delivered to the selector switch 36X, where one of this Rch audio signal and the signal from the QMF synthesizer 33 is selected, and the selected signal is delivered to an output terminal 38.

Here, operations of various sections including switching of the playback apparatus of FIG. 2 are controlled by a control section, not shown, in accordance with the content of input coded information, states of the various sections, or the like.

When compared with the configuration of the playback apparatus shown in the above-mentioned FIG. 9, this playback apparatus shown in FIG. 2 differs therefrom in the following points. Its switching configurations downstream of the QMF analyzer 21 and of the envelope adjuster 24 are modified. The switches 17, 18 and the selector switch 19 are added. The state variable of one of the QMF synthesizers 33, 34 is replicated for the other.

Figure 8:
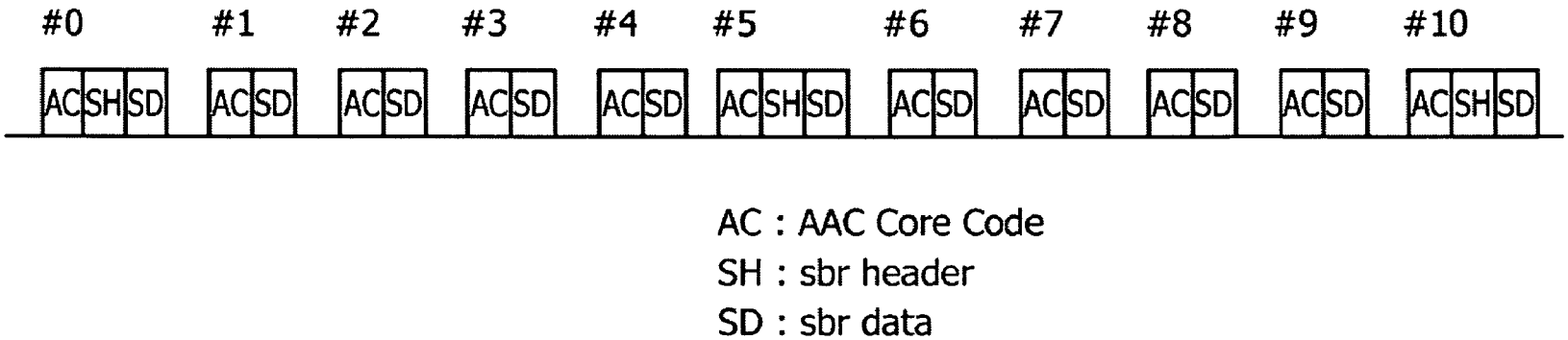
FIG. 8 is a diagram showing an example of a signal to be supplied to a stereo process apparatus of the HE AAC v2 system.

A case will be described where coded audio data is supplied from an arbitrary frame (transmission unit) as mentioned above, in the playback apparatus of FIG. 2. For example, if the input starts at the position corresponding to the transmission unit #2 of the above-mentioned FIG. 8, the SBR header SH being the necessary stereo process information contained in the transmission unit #0 is not supplied. Thus, the apparatus cannot decode the SBR data SD while receiving the transmission units #2 to #4, so that usable stereo process information (PS data) cannot be acquired. Consequently, the apparatus initializes its internal state variables (delay signals) of the QMF analyzer 21, hybrid analyzer 27, QMF synthesizers 33, 34, and the like of the SBR processor 20. Next, when the data at the position corresponding to the transmission unit #5 of the above-mentioned FIG. 8 is supplied and an SBR header SH being the necessary stereo process information is thus supplied, the apparatus can decode the SBR data SD and thus acquires the usable stereo process information (PS data). As a result, the apparatus updates its internal state variables (delay signals) of the QMF analyzer 21, hybrid analyzer 27, QMF synthesizers 33, 34, and the like of the SBR processor 20. These state variables (delay signals) each means data (a signal) held at a delay element within a filter. In a filtering process, a delay occurs within a period from the input to the output of a signal in accordance with a filtering length, and the state variable means this delay signal.

Here, in the state in which the usable stereo process information (PS data) cannot be acquired and hence the internal state variables are initialized, the selector switches 22X, 35X, 36X are switched for connection to the selectable terminals A. Under this condition, the QMF analyzer 21 band-divides the monaural audio signal from the AAC core decoder 13, and the Lch QMF synthesizer 33 band-synthesizes the band-divided signals to output identical audio signals from the left and right channels.

Then, when multiplexed coded information is transmitted, the selector switches 22X, 35X, 19, 36X are switched for connection to their selectable terminals B, C. In this case, the terminals B are selected when the coded information contains only band extension coded information, whereas the terminals C are selected when the coded information contains the band extension coded information (HF generation information) and stereo process information.

A case will be described below where an SBR header SH being the necessary stereo process information is transmitted, whereby the playback apparatus decodes SBR data SD, and thus acquires stereo process information (PS data). When the coded information (SBR data) for the SBR process and the stereo process information (PS data) are acquired, the apparatus becomes ready to deliver a signal to the Rch QMF synthesizer 34 for the first time. For this reason, when generating output audio signals without considering the state variables (delay signals), the apparatus outputs a state variable initialization signal to the Rch audio signal, thereby causing abnormal sounds. In view of this, in the embodiment of the present invention, the judgment output from the Lch replication process judgment section 16 is used at this timing to replicate the state variable (delay signal) of the Lch QMF synthesizer 33 for the Rch QMF synthesizer 34 in a state variable replication process. Through this operation, a state variable equivalent to the state variable of the Lch QMF synthesizer 33 is set to the Rch QMF synthesizer 34 despite the fact that the playback apparatus were playing back the coded audio data with the selector switches connected to their selectable terminals A until the stereo process information was transmitted. When the above-mentioned replication process is executed, the selector switches 22X, 35X, 19, 36X are switched for connection to selectable terminals F.

Usually, when an irrelevant, arbitrary signal is used as a delay signal during a band synthesis process, unexpected amplification/damping is occurred during the band synthesis process, thereby causing abnormal sounds. In a method according to the present embodiment, any frame from which multiplexed coded information is acquired for the first time after an initialization marks a switching point from monaural output to stereo output, so that even if the state variable (delay signal) of the Lch QMF synthesizer 33 is used as a state variable (delay signal) of the Rch QMF synthesizer 34, no abnormal sounds will occur.

Further, in the stereo process (PS process), in order to apply spatial coded information, the playback apparatus performs band division by the hybrid analyzer 27, a stereo signal generation process based on the de-correlation result from the signal de-correlator 29 and the transmitted spatial information, and hybrid synthesis. Since the hybrid analyzer 27 requiring a delay also performs its process for the first time after multiplexed coded information is decoded, its state variable (delay signal) at the time when the multiplexed coded information is acquired for the first time after the initialization of a variable within the decoder is as initialized, and this influences de-correlation by the signal de-correlator 29, thereby causing abnormal sounds. Namely, the band-divided signals obtained by the QMF analyzer 21 are supplied to the hybrid analyzer 27, and since the state variable (delay signal) of the hybrid analyzer 27 is as initialized, the downstream processing is not performed correctly.

In view of this, in the present embodiment, in order to eliminate this influence, when the hybrid analyzer 27 performs its process for the first time after an initialization, the playback apparatus performs a process of updating Lch, Rch stereo signal generation coefficients for both the hybrid analyzer 27 and the stereo processor 30 in order to update their delay signals. For output, the switches 35X, 19 are switched to the selectable terminals F, so that signals branched before the hybrid analyzer 27 are outputted to the QMF synthesizers 33, 34 of the respective channels.

Specifically, the stereo signals are disconnected by the switches 17, 18 (the switches 17, 18 are turned off) until the state variable (delay signal) of the hybrid analyzer 27 is fully updated. Instead, the signals delivered via the selectable terminals F of the selector switches 22X, 35X are delivered to the Lch QMF synthesizer 33 and to the Rch QMF synthesizer 34 via the selectable terminal F of the selector switch 19. A resultant signal from the Lch QMF synthesizer 33 is outputted from the output terminal 37, whereas a resultant signal from the Rch QMF synthesizer 34 whose state variable is identical with that of the Lch QMF synthesizer 33 is outputted from the output terminal 38 via the selectable terminal F of the selector switch 36X.

The state variable (delay signal) of the hybrid analyzer 27, as clearly described in Section 8.6.4 of the above-cited Non-Patent Reference 1, has a delay by 6 QMF samples. The process of updating the Lch, Rch stereo signal generation coefficients of the stereo processor 30 is required to be performed, since the coefficients are transmitted as difference information, as described in Section 8.6.4.4 of the above-cited Non-Patent Reference 1.

When the state variable (delay signal) of the hybrid analyzer 27 is fully updated, the switches 17, 18 are both turned on (connected to selectable terminals E), so that the Lch, Rch stereo signals from the stereo processor 30 are delivered to the hybrid synthesizers 31, 32, respectively. The selector switches 35X, 19, 36X are switched for connection to selectable terminals E, respectively, so that the signals from the hybrid synthesizer 31 are processed at the QMF synthesizer 33, and a resultant signal is outputted from the output terminal 37 as the Lch stereo audio signal, whereas the signals from the hybrid synthesizer 32 are processed at the QMF synthesizer 34, and a resultant signal is outputted from the output terminal 38 as the Rch stereo audio signal. It is noted that the playback apparatus can connect the switches 17, 18 and the selector switches 35X, 19, 36X to their selectable terminals E by updating the state variable of the Rch QMF synthesizer 34 even while updating the state variable of the hybrid analyzer 27, whereby the apparatus can switch these switches without causing abnormal sounds within its processing of a single frame.

Figure 3:
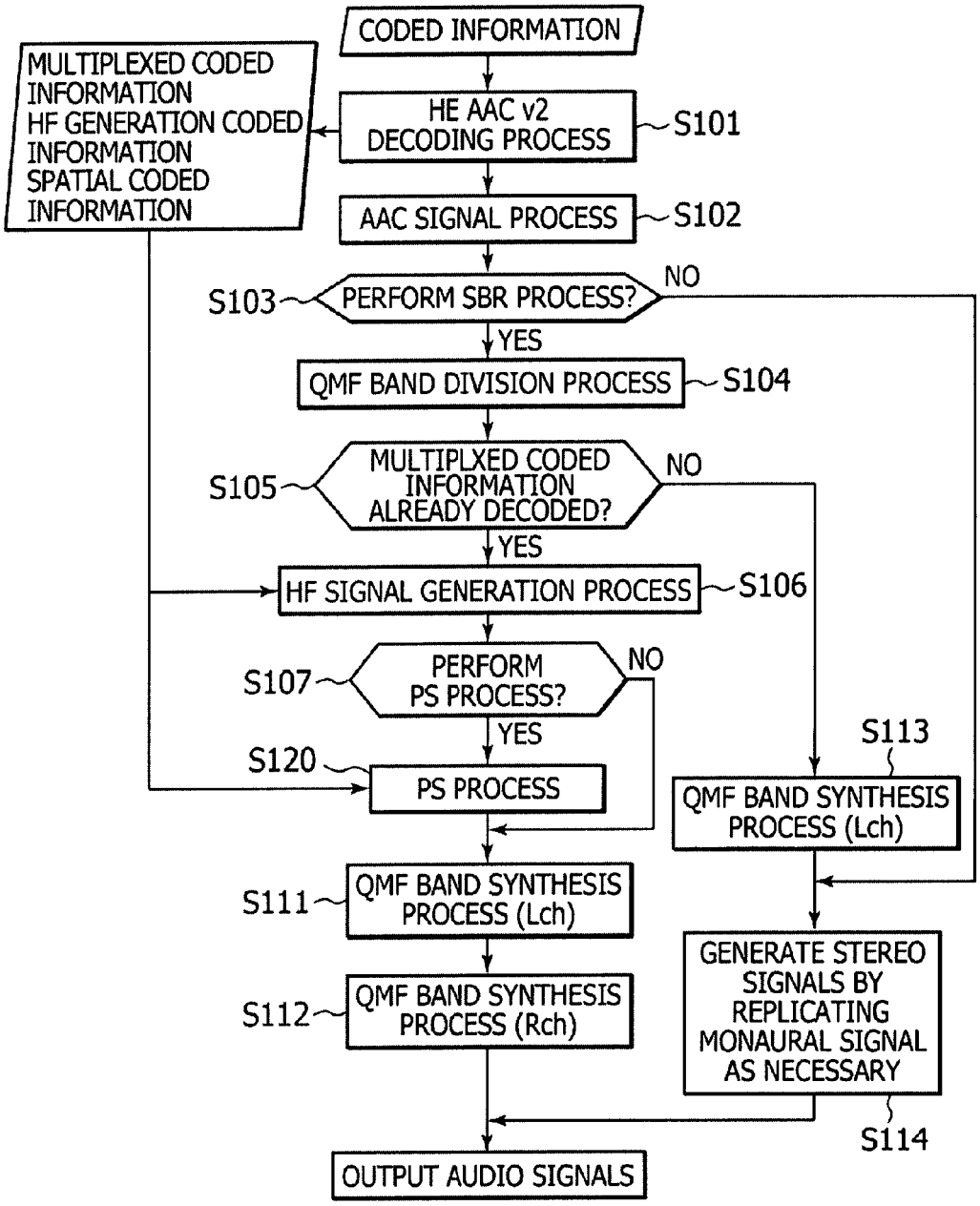
FIG. 3 is a flowchart for illustrating an operation of the playback apparatus shown in FIG. 2.
Figure 4:
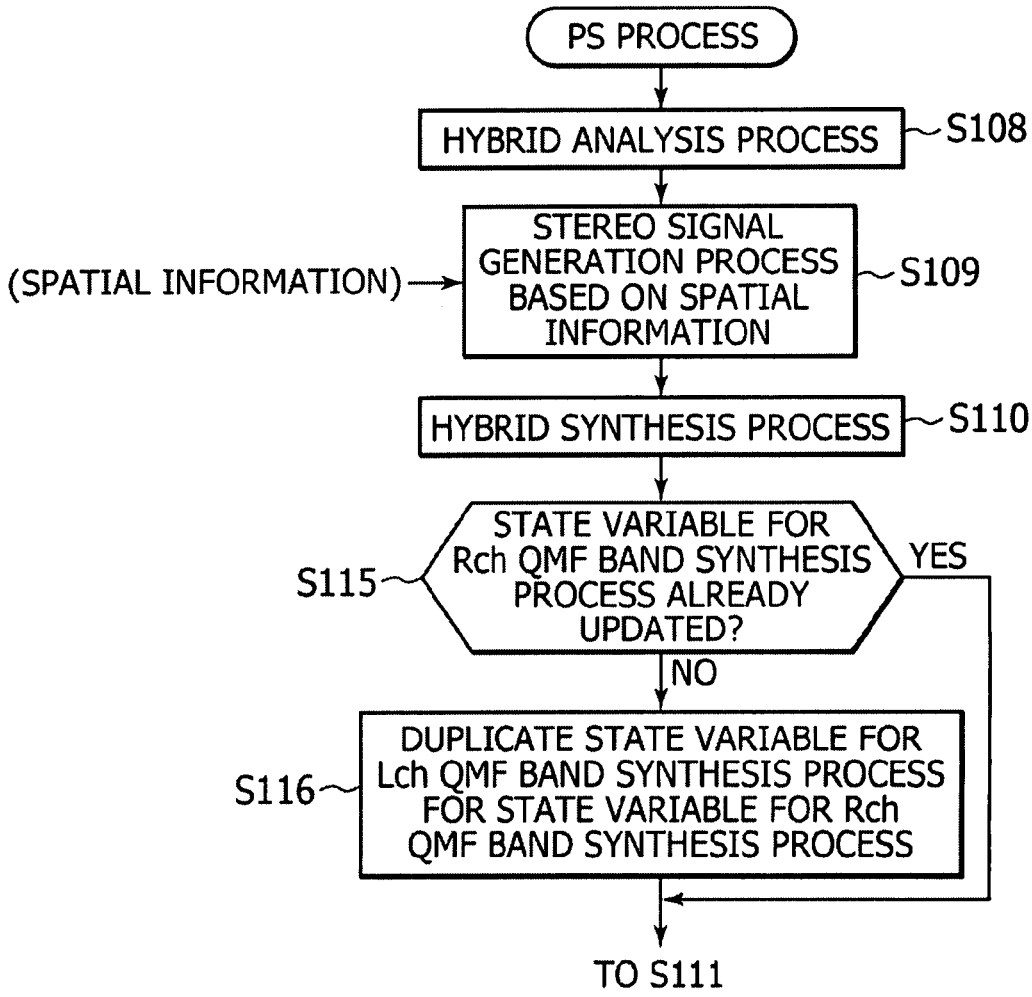
FIG. 4 is a flowchart for illustrating a specific example of a PS process in step S120 of FIG. 3.
Figure 5:
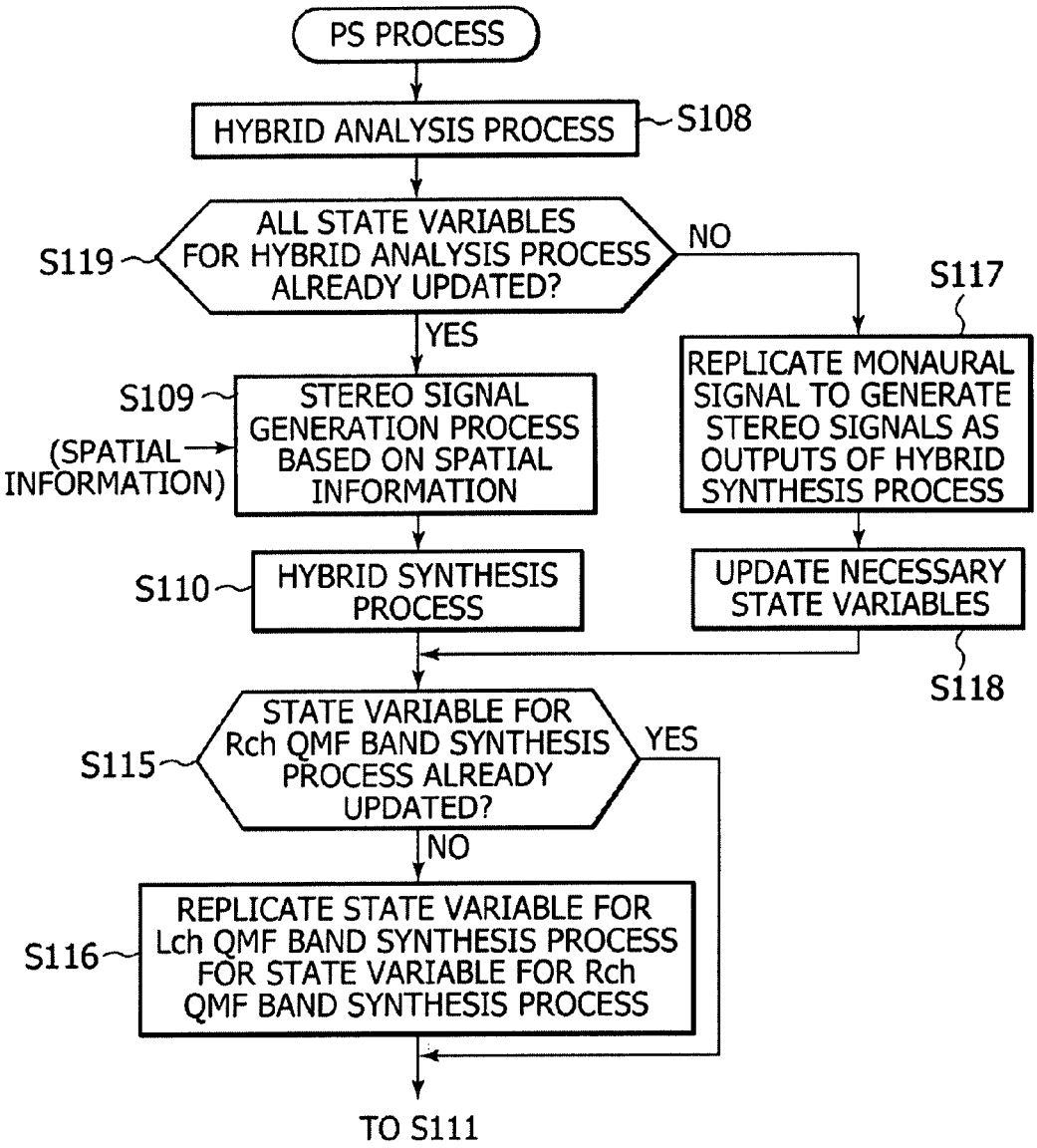
FIG. 5 is a flowchart for illustrating another specific example of the PS process in step S120 of FIG. 3.

FIGS. 3 to 5 are flowcharts for illustrating a decoding operation such as described above, e.g., in the configuration of the above-mentioned FIG. 2.

In FIG. 3, on coded information such as the coded audio stream to be supplied to the above-mentioned input terminal 11, a decoding (deformatting) process for data coded by the above-mentioned HE AAC v2 system is performed in step S101 to extract HF generation coded information (SBR data) and spatial coded information (PS data) such as mentioned above, as multiplexed coded information. Further, on the above-mentioned AAC core information, an AAC signal process is performed in step S102. In the following step S103, it is judged whether or not the above-mentioned SBR process is to be performed. If YES, the process proceeds to step S104, whereas if NO, the process proceeds to step S114. These processes correspond to, e.g., the processing performed by the payload deformatter 12 and the AAC core decoder 13 of FIG. 2.

In step S104, a QMF band division process is performed by, e.g., the above-mentioned QMF analyzer 21. In the following step S105, it is judged whether or not the multiplexed coded information is already decoded. If YES, the process proceeds to step S106, whereas if NO, the process proceeds to step S113. In step S106, an HF signal generation process is performed using multiplexed HF signal generation coded information (already decoded information) by, e.g., the above-mentioned HF generator 23. In the following step S107, it is judged whether or not the PS process is to be performed.

If it is judged YES (the PS process is to be performed) in step S107, the process goes to step S111 after the PS process is performed in step S120, whereas if it is judged NO (the PS process is not to be performed) in step S107, the process proceeds directly to step S111. A specific example of the PS process in step S120 will be described later with reference to FIG. 4 or 5.

In step S111, an Lch QMF band synthesis process is performed, and in step S112, an Rch QMF band synthesis process is performed. Then, resultant audio signals are outputted. Furthermore, in the above-mentioned step S113, the Lch QMF band synthesis process is performed, and in step S114, a monaural signal is replicated, as necessary, to generate stereo signals. Then, resultant audio signals are outputted. These processes correspond to, e.g., the processing performed by the QMF synthesizers 33, 34 via the selector switches 35X, 36X, and the like of the above-mentioned FIG. 2.

FIG. 4 shows a specific example of the PS process in the above-mentioned step S120 in the embodiment of the present invention. When it is judged YES (the PS process is to be performed) in S107 of the above-mentioned FIG. 3, the process proceeds to step S108, where a hybrid analysis process is performed, and in step S109, a spatial information-based stereo signal generation process is performed. Then, after a hybrid synthesis process is performed in step S110, control proceeds to step S115. In step S115, it is judged whether or not a state variable (delay signal) for the Rch QMF band synthesis process, e.g., the state variable of the QMF synthesizer 34 of FIG. 2 is already updated. If YES, the process proceeds to step S111 of the above-mentioned FIG. 3, whereas if NO, the process proceeds to step S116. In step S116, the state variable for the Lch QMF band synthesis process is replicated, for a state variable for the Rch QMF band synthesis process, after which control proceeds to S111 of the above-mentioned FIG. 3. These processes correspond to, e.g., processing extending from the processing performed by the hybrid analyzer 27 to the processing performed by the QMF synthesizers 33, 34 of FIG. 2.

In these specific examples shown in FIGS. 3, 4, in performing a playback from an arbitrary frame of coded audio data which is transmitted with part of coded information multiplexed thereinto, it is arranged to initialize the internal state of the playback apparatus, to band-divide a monaural audio signal into at least two subbands even in the absence of the coded information which is transmitted as multiplexed, and to up-sample resultant signals by a band synthesis filtering process from which a delay occurs, to output monaural audio signals. Thereafter, when multiplexed coded information is supplied and the process of generating stereo signals from the monaural signal is performed for the first time, by processing the filtering state variable (delay signal) for the monaural signal as filtering state variables for the stereo signals (steps S114, S115, S116), it is arranged to prevent occurrence of abnormal sounds due to the delays caused by the filtering processes.

Next, FIG. 5 shows another specific example of the PS process in step S120 of the above-mentioned FIG. 3, in the embodiment of the present invention. Namely, when it is judged YES (the PS process is to be performed) in step S107 of the above-mentioned FIG. 3, the process proceeds to step S108 of FIG. 5, where a hybrid analysis process (e.g., the process by the hybrid analyzer 27 of FIG. 2) is performed. Thereafter, the process proceeds to step S119, where it is judged whether or not all the state variables (delay signals) for the above-mentioned hybrid analysis process are already updated. If YES, the process goes to step S109, whereas if NO, the process goes to step S117. In step S109, a spatial information-based stereo signal generation process is performed, and in step S110, a hybrid synthesis process is performed. Thereafter, the process proceeds to step S115. In step S117, since all the state variables for the above-mentioned hybrid analysis process are not updated yet, the monaural signal is replicated to generate stereo signals, and uses the generated stereo signals as outputs of the hybrid synthesis process. Then, control proceeds to step S118, where necessary state variables are updated, after which the process proceeds to step S115.

In step 3115, it is judged whether or not the state variable (e.g., the state variable of the QMF synthesizer 34 of FIG. 2) for the Rch QMF band synthesis process is updated. If YES, the process proceeds to step S111 of the above-mentioned FIG. 3, whereas if NO, the process proceeds to step S116. In step S116, the state variable for the Lch QMF band synthesis process is replicated for a state variable for the Rch QMF band synthesis process, after which control proceeds to step S111 of the above-mentioned FIG. 3.

In these specific examples shown in FIGS. 3, 5, in addition to the configuration of the specific example described along with the above-mentioned FIG. 4, the filtering state variable updating process and the output signal replication process are performed until at least all the filtering state variables (delay signals) are updated, so that the delays in the filtering processes will not affect the output audio signals, as shown in steps S119, S117, S118. Then, after all the filtering state variables (delay signals) are updated, a normal playback process is performed, whereby occurrence of abnormal sounds in the output audio signals due to the delays in the filtering processes is prevented.

Figure 10:
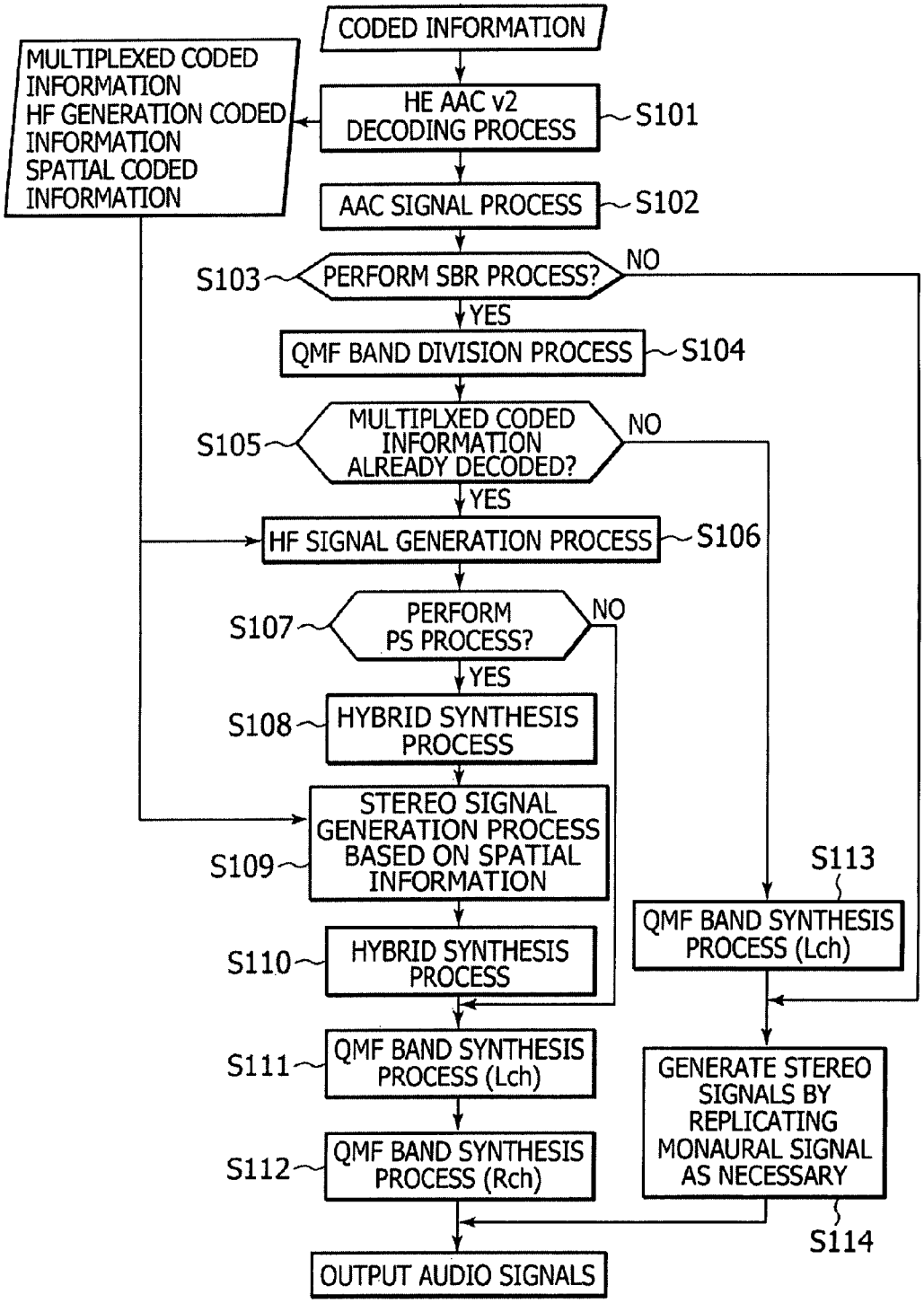
FIG. 10 is a flowchart for illustrating an operation of the playback apparatus shown in FIG. 9.
Figures 11A, 11B, 11C, 11D:
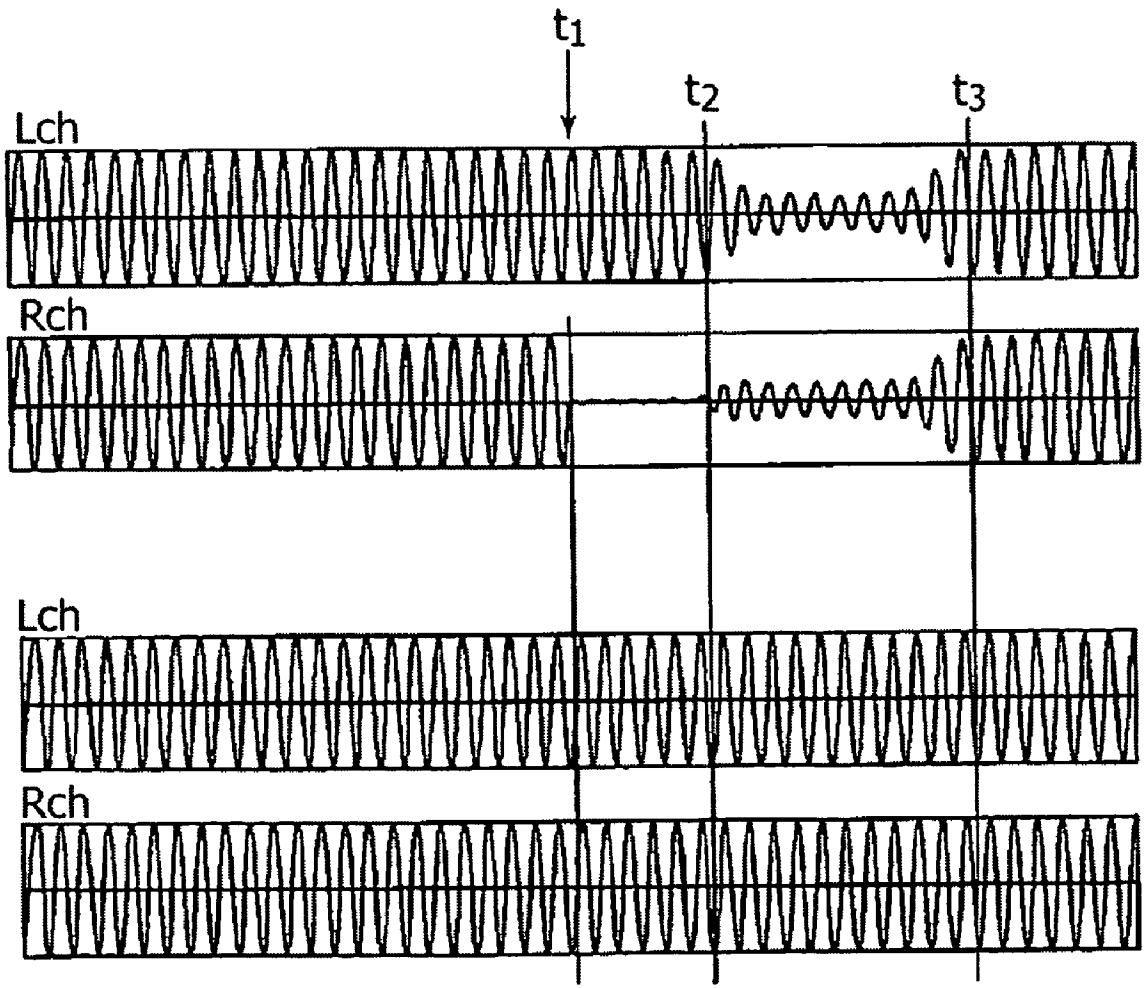
FIG. 11 is a waveform diagram comparing output audio signals from the related-art playback apparatus with output audio signals from the playback apparatus to which the embodiment of the present invention is applied.

FIGS. 11C, 11D show examples of such Lch, Rch stereo output audio signals in the embodiment of the present invention. The description mentioned above with reference to FIGS. 10A, 10B similarly applies to times t1 to t3. Namely, usable stereo process information is absent (e.g., only an AAC-LC (Low Complexity) coded information signal is supplied, and only up-sampling is performed in the SBR process) up to the time t1. At the time t1, multiplexed coded information containing stereo process information becomes effective (usable), whereby the AAC process, the SBR process, the PS process are started. FIG. 11C shows the Lch output audio signal, and FIG. 11D shows the Rch output audio signal.

The Lch, Rch stereo output audio signals shown in FIGS. 11C, 11D in the embodiment of the present invention are free from, as is apparent from a comparison with the related-art output audio signals shown in FIGS. 11A, 11B, the influence of the state variable (delay signal) of a band synthesizer (the QMF synthesizer 34) for the above-mentioned SBR process between the times t1 and t2 and the influence of the state variable of a hybrid filter (the hybrid analyzer 27) for the above-mentioned PS process between the times t2 and t3. According to the embodiment of the present invention, good stereo audio signals can be played back, which are free from abnormal sounds and the like, even if multiplexed coded information (stereo process information and the like) is supplied for the first time from a state in which the internal state variables are initialized.

According to the above-described embodiment of the present invention, in decode-processing and playing back coded audio data which is transmitted with part of coded information containing stereo process information multiplexed into a monaural audio signal, it is arranged to initialize internal state variables (delay signals) under a state in which the above-mentioned multiplexed coded information which is usable is not supplied, and to output stereo audio signals using the monaural audio signal. When the above-mentioned multiplexed coded information is supplied in a state in which the above-mentioned internal state variables are initialized, it is arranged to start updating the internal state variables, and to output the stereo audio signals using the monaural audio signal until all the state variables are updated. When all the above-mentioned state variables are updated, it is arranged to perform a signal process including a stereo process based on the above-mentioned multiplexed coded information, on the above-mentioned monaural audio signal to generate and output stereo audio signals.

Namely, in decode-processing and playing back coded audio data which is transmitted with part of coded information containing stereo process information intermittently multiplexed into a monaural audio signal, if the stereo process information is not supplied, it is arranged to output stereo audio signals using the monaural audio signal. If the stereo process information is supplied, it is arranged to start updating internal state variables within filters, and to output the stereo audio signals using the monaural audio signal until all the state variables are updated. If all the state variables within the filters are updated, it is arranged to perform a stereo process based on the stereo process information, on the monaural audio signal to generate and output stereo audio signals.

In another embodiment of the present invention, there is provided a coded audio data playback apparatus. The playback apparatus includes decoding means, information acquisition means, audio signal band division means, high frequency information generation means, stereo signal generation means, subband-divided signal synthesis means, and output audio signal generation means. The decoding means decodes coded audio data which is transmitted with part of coded information multiplexed thereinto. The information acquisition means acquires information for generating output audio signals from part of the transmitted coded information even if the part of the multiplexed coded information is not transmitted. The audio signal band division means performs division into at least two subbands to generate band-divided signals. The high frequency information generation means generates high frequency information for the generated band-divided signals when band extension coded information is transmitted. The stereo signal generation means causes subband-divided signal generation means requiring a delay to generate subband-divided signals with regard to the band-divided signal, and generates stereo signals from a monaural signal based on spatial coded information, when the spatial coded information is transmitted. The subband-divided signal synthesis means synthesizes the subband-divided signals into the band-divided signals. The output audio signal generation means causes audio signal synthesis means requiring a delay to synthesize the synthesized band-divided signals to generate output audio signals. In the playback apparatus, in a playback from a discontinuous position (frame), there are provided subband signal generation means, state variable initialization means, playback continuing means, and monaural signal state variable utilization means. The subband signal generation means requires a delay of the coded audio data playback apparatus. The state variable initialization means initializes state variables (delay signals) of the audio signal synthesis means. The playback continuing means continues the playback after the above-mentioned initialization. The monaural signal state variable utilization means performs, in decoding the spatial coded information when the multiplexed coded information is transmitted for a first time after the above-mentioned initialization, and in generating the stereo signals from the monaural signal, a process using a state variable (delay signal) for the monaural signal as the state variables (delay signals) of audio signal synthesis means for the generated stereo signals.

Furthermore, there are also provided pseudo-subband-divided signal generation means, replication and output means, updating means, and stereo signal generation performing means. The pseudo-subband-divided signal generation means performs, in decoding the spatial coded information when the multiplexed coded information is transmitted for a first time after such an initialization of delay signals of the coded audio data playback apparatus, and in generating the stereo signals from the monaural signal, subband-divided signal generation in a pseudo manner until all state variables (delay signals) of the subband-divided signal generation means are updated. The replication and output means replicates monaural band-divided signals supplied to the subband-divided signal generation means during a period in which the pseudo-subband-divided signal generation means is operating in the pseudo manner, and outputs stereo band-divided signals to the audio signal synthesis means. The division coefficient updating means updates division coefficients to be updated by a difference of the stereo signal generation means for generating the stereo signals from the monaural signal, during the period in which the pseudo-subband-divided signal generation means is operating in the pseudo manner. The stereo signal generation performing means generates the stereo signals from the monaural signal on the basis of the spatial coded information after all the delay signals of the subband-divided signal generation means are updated.

Namely, in performing a normal playback from an arbitrary frame by a decoding process for coded audio data which is transmitted with part of coded information multiplexed thereinto, it is arranged to initialize a delay signal of a decoder, to divide into at least two subbands, even if the coded information which is transmitted as multiplexed is absent, and to perform up-sampling by a band synthesis filtering process requiring a delay to replicate the monaural audio signal, whereby the replicated monaural audio signals can be outputted as stereo audio signals, whereas it is arranged, when the coded information is transmitted for the first time and the spatial coded information is thus effective, to process a delay signal for an audio signal band synthesis process for the monaural signal as delay signals for audio signal band synthesis processes for the stereo signals, whereby occurrence of abnormal sounds in the output audio signals due to delays in QMF synthesis filtering processes.

Furthermore, the delay signal updating process and the output signal replication process are performed until all the delay signals of at least the subband division filtering process are updated so that the delay in the subband division filtering process will not affect the output audio signals. Then, after all the delay signals are updated, a normal playback process is performed, whereby occurrence of abnormal sounds in the output audio signals due to the delays caused by the filtering processes can be prevented.

As a result of these arrangements, even in coded audio data requiring a spatial decoding process, which is transmitted with part of coded information multiplexed thereinto, a playback from an arbitrary position can be realized without causing abnormal sounds.

It is noted that the present invention is not limited only to the above-described embodiment, but can, of course, be modified in various ways without departing from the scope and spirit of the present invention. For example, in the above-described embodiment of the present invention, a playback apparatus or a playback method having a hardware configuration has been disclosed. However, the above-described process steps can be realized by software, i.e., by causing a computer using a CPU (Central Processing Unit) to execute a program. Additionally, this computer program can be provided as recorded on a recording medium.

According to the embodiments of the present invention, good stereo audio signals free from occurrence of abnormal sounds can be played back even in a case from the necessary stereo process information is not supplied to the necessary stereo process information is supplied.

It should be understood by those skilled in the art that various modifications, combinations, sub-combinations and alterations may occur depending on design requirements and other factors insofar as they are within the scope of the appended claims or the equivalents thereof.

CROSS REFERENCES TO RELATED APPLICATIONS

The present document contains subject matter related to Japanese Patent Applications JP 2006-324775 and JP 2007-272856 filed in the Japanese Patent Office on Nov. 30, 2006, and Oct. 19, 2007, respectively, the entire contents of which being incorporated herein by reference.

What is claimed is:

1. A playback method for decode-processing and playing back coded audio data which is transmitted with necessary stereo process information required for a stereo process intermittently multiplexed into coded information of a monaural audio signal, the playback method comprising:

monitoring a state of the necessary stereo process information;

outputting stereo audio signals using the monaural audio signal with a delay, if the necessary stereo process information is not supplied;

starting updating stereo variables within filters, and outputting the stereo audio signals using the monaural audio signal until all the state variables are updated, if the necessary stereo process information is supplied for the first time from a state in which the necessary stereo process information is not supplied; and performing the stereo process based on stereo process information acquired by the necessary stereo process information, on the monaural audio signal to generate and output stereo audio signals, after all the state variables within the filters are updated.

2. The playback method according to claim 1, wherein:

the stereo process is performed on band-extended monaural audio signals.

3. The playback method according to claim 1, wherein:

in outputting step, the monaural audio signal is divided into at least two subbands by a band division filtering process, and the at least two subbands are up-sampled by a band synthesis filtering process, to output the stereo audio signals using the monaural audio signal, and in updating step, a state variable within a filter for the monaural audio signal is processed as filtering state variables for the stereo audio signals.

4. The playback method according to claim 1, wherein:

the coded audio data has:

AAC core coded information equivalent to the monaural audio data based on an HE AAC (High Efficiency Advanced Audio Coding) coding system, coded information for an SBR (Spectral Band Replication) process, and encoded information for a PS (Parametric Stereo) process, wherein:

the coded information for the SBR process includes SBR data (sbr data) being coded information which is always transmitted and an SBR header (sbr header) being coded information which is intermittently transmitted as multiplexed, PS data (ps data) being the coded information for the PS process is transmitted as contained in an extended area of the SBR data, and the SBR header is the necessary stereo process information required for decoding the SBR data.

5. A playback apparatus for decode-processing and playing back coded audio data which is transmitted with necessary stereo process information required for a stereo process intermittently multiplexed into coded information of a monaural audio signal, the playback apparatus comprising:

band division means for band-dividing the monaural audio signal which is supplied;

stereo processing means for stereo-processing signals from the band division means on the basis of the stereo process information contained in the multiplexed coded information;

band synthesis means for band-synthesizing left-channel and right-channel stereo signals from the stereo processing means, separately; and control means for monitoring a state of the necessary stereo process information, performing control to output stereo audio signals using the monaural audio signal through a delay section, if the necessary stereo process information is not supplied, for performing control to start updating state variables within filters and to output the stereo audio signals using the monaural audio signal until all the state variables are updated if the necessary stereo process information is supplied for the first time from a state in which the necessary stereo process information is not supplied, and for performing control to perform the stereo process based on stereo process information acquired by the necessary stereo process information, on the monaural audio signal to generate and output stereo audio signals after all the state variables within the filters are updated.

6. The playback apparatus according to claim 5, wherein the stereo process is performed on band-extended monaural audio signals.

7. A non-transitory recording medium on which a program for causing a computer to execute a process of decode-processing and playing back coded audio data which is transmitted with necessary stereo process information required for a stereo process intermittently multiplexed into coded information of a monaural audio signal, is recorded, the process comprising:

monitoring a state of the necessary stereo process information;

outputting stereo audio signals using the monaural audio signal with a delay, if the necessary stereo process information is not supplied;

starting updating stereo variables within filters, and outputting the stereo audio signals using the monaural audio signal until all the state variables are updated, if the necessary stereo process information is supplied for the first time from a state in which the necessary stereo process information is not supplied; and performing the stereo process based on stereo process information acquired by the necessary stereo process information, on the monaural audio signal to generate and output stereo audio signals, after all the state variables within the filters are updated.

* * * * *